US007562970B2

(12) United States Patent
Okuda et al.

(10) Patent No.: US 7,562,970 B2
(45) Date of Patent: Jul. 21, 2009

(54) INK-JET HEAD AND INK-JET RECORDING DEVICE

(75) Inventors: Satoshi Okuda, Kiyosu (JP); Narumi Koga, Nagoya (JP); Kazuma Goto, Nagoya (JP); Atsushi Ito, Nagoya (JP); Koichiro Hara, Nagoya (JP); Masaharu Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 418 days.

(21) Appl. No.: 11/627,834

(22) Filed: Jan. 26, 2007

(65) Prior Publication Data

US 2007/0176969 A1 Aug. 2, 2007

(30) Foreign Application Priority Data

Jan. 27, 2006 (JP) ..... 2006-019854

(51) Int. Cl.
*B41J 2/045* (2006.01)

(52) U.S. Cl. ..... 347/68

(58) Field of Classification Search ..... 347/68, 347/69–72, 46–47, 44, 20, 9; 400/124.16
See application file for complete search history.

(56) References Cited

U.S. PATENT DOCUMENTS 5,402,159 A 3/1995 Takahashi et al.
6,964,469 B2 * 11/2005 Sanada ..... 347/46
2005/0062805 A1 3/2005 Ito
2005/0134663 A1 6/2005 Sasaki et al.
2005/0146577 A1 7/2005 Sasaki et al.
2005/0146578 A1 7/2005 Takagi et al.
2005/0146579 A1 7/2005 Sasaki et al.
2005/0151812 A1 7/2005 Sasaki et al.
2005/0195225 A1 9/2005 Takagi et al.
2006/0001717 A1 1/2006 Sasaki et al.
2007/0097162 A1 * 5/2007 Iwashita et al. ..... 347/9

FOREIGN PATENT DOCUMENTS

JP H04-341853 A 11/1992
JP 2005-096171 A 4/2005
JP 2005-238473 A 9/2005

* cited by examiner

*Primary Examiner*—K. Feggins
(74) *Attorney, Agent, or Firm*—Baker Botts, LLP.

(57) ABSTRACT

In one embodiment, the disclosure relates to an ink-jet head including an ink chamber, a pressure chamber in communication with the ink chamber, a nozzle for ejecting an ink in communication with the pressure chamber, a piezoelectric actuator for applying an ejection pressure to an ink in the pressure chamber, and an ink passage extending from a boundary of the ink chamber to a tip of the nozzle. The tip of the nozzle has an aperture diameter of from about 15 to about 25 μm, and the ink passage is configured such that when an ink having a viscosity of from about 2.5 to about 3 mPa·s is passed therethrough, a passage resistance value of the ink passage is from about 50 to about 100 kPa·s/mm$^3$. Another embodiment of the disclosure relates to an ink-jet recording device containing such an ink-jet head.

20 Claims, 6 Drawing Sheets

INK-JET HEAD AND INK-JET RECORDING DEVICE

BACKGROUND OF THE INVENTION

This application claims the benefit of Japanese Patent Application No. 2006-019854, filed Jan. 27, 2006, which is incorporated herein by reference.

1. Field of the Invention

Embodiments of the invention relate to an ink-jet head and an ink-jet recording device provided with that head.

2. Description of the Related Art

Various ink-jet ejection systems may be used in the ink-jet head of an ink-jet recording device. In one type of ink-jet ejection system, a piezo system, a piezoelectric element is widely utilized to exert pressure on the ink and cause its ejection from a nozzle. A representative ink-jet head of the piezo system is configured such that an ink in an ink chamber provided therein moves into a pressure chamber via a connection passage, and further moves into a nozzle in communication with the pressure chamber, and is finally ejected on a recording medium from an aperture of a tip of the nozzle. An ejection pressure is applied to the ink in the pressure chamber by deformation of a piezoelectric actuator which covers the pressure chamber. Deformation of this piezoelectric actuator is caused by applying a voltage to it.

An ink-jet recording device provided with such an ink-jet head may be use to achieve printing with a higher resolution. In order to achieve this, the ink should be ejected as a smaller droplet, for example a droplet of several pl (picoliters), from the nozzle. For that reason, it is desirable to make an aperture diameter of the tip of the nozzle (such as, the nozzle diameter) smaller than the related-art diameter of from about 30 to 50 μm (from 10 to 50 pl in the resulting droplet).

However, when the nozzle diameter is made small, an ink present in an ejection hole in the nozzle tip or an ink droplet attached in the surroundings of the ejection hole is likely to dry out. This often results in ejection failure. In order to improve such ejection failure, it may be possible to lower a viscosity of the ink by, for example, increasing the amount of a solvent. However, when the viscosity of the ink is lowered, because the vibration of a meniscus hardly ceases, stable ink ejection is difficult.

SUMMARY OF THE INVENTION

One object of embodiments of the present invention is to provide an ink-jet head provided with a small nozzle diameter such as used in a piezo system to form high resolution images that does not significantly suffer from ejection failure and is able to stably eject an ink and an ink-jet recording device provided with that head.

Another object of the present invention is to provide an ink-jet recording device having an ink-jet head as described above.

Other objects, features, and advantages will be apparent to those skilled in the art from the following detailed description and accompanying drawings.

BRIEF DESCRIPTION OF THE DRAWINGS

Embodiments of the invention are described in detail with reference to the following drawings, in which like features are indicated by like numbers.

DETAILED DESCRIPTION OF EMBODIMENTS OF THE INVENTION

The present inventors have found that, when a nozzle diameter of an ink-jet head of a piezo system is miniaturized so as to cope with the formation of an image with high resolution, ejection failure or instability of ejection is closely correlated with a passage resistance of an ink passage of the ink-jet head.

Accordingly, embodiments of the invention provide an ink-jet head including an ink chamber, a pressure chamber in communication with the ink chamber via a connection passage, a nozzle for ejecting an ink in communication with the pressure chamber, a piezoelectric actuator for applying an ejection pressure to an ink in the pressure chamber, and an ink passage extending from a boundary of the ink chamber to a tip of the nozzle. The tip of the nozzle may have an aperture diameter of from about 15 to about 25 μm, and the ink passage may be configured such that when an ink having a viscosity of from about 2.5 to about 3 mPa·s is passed therethrough, a passage resistance value of the ink passage is from about 50 to about 100 kPa·s/mm$^3$.

Also, embodiments of the invention may provide an ink-jet recording device provided with such an ink-jet head.

One embodiment of an ink-jet head of the invention is described below with reference to the accompanying drawings, but it should not be construed that the ink-jet head of the invention is limited to this embodiment.

Figure 1:
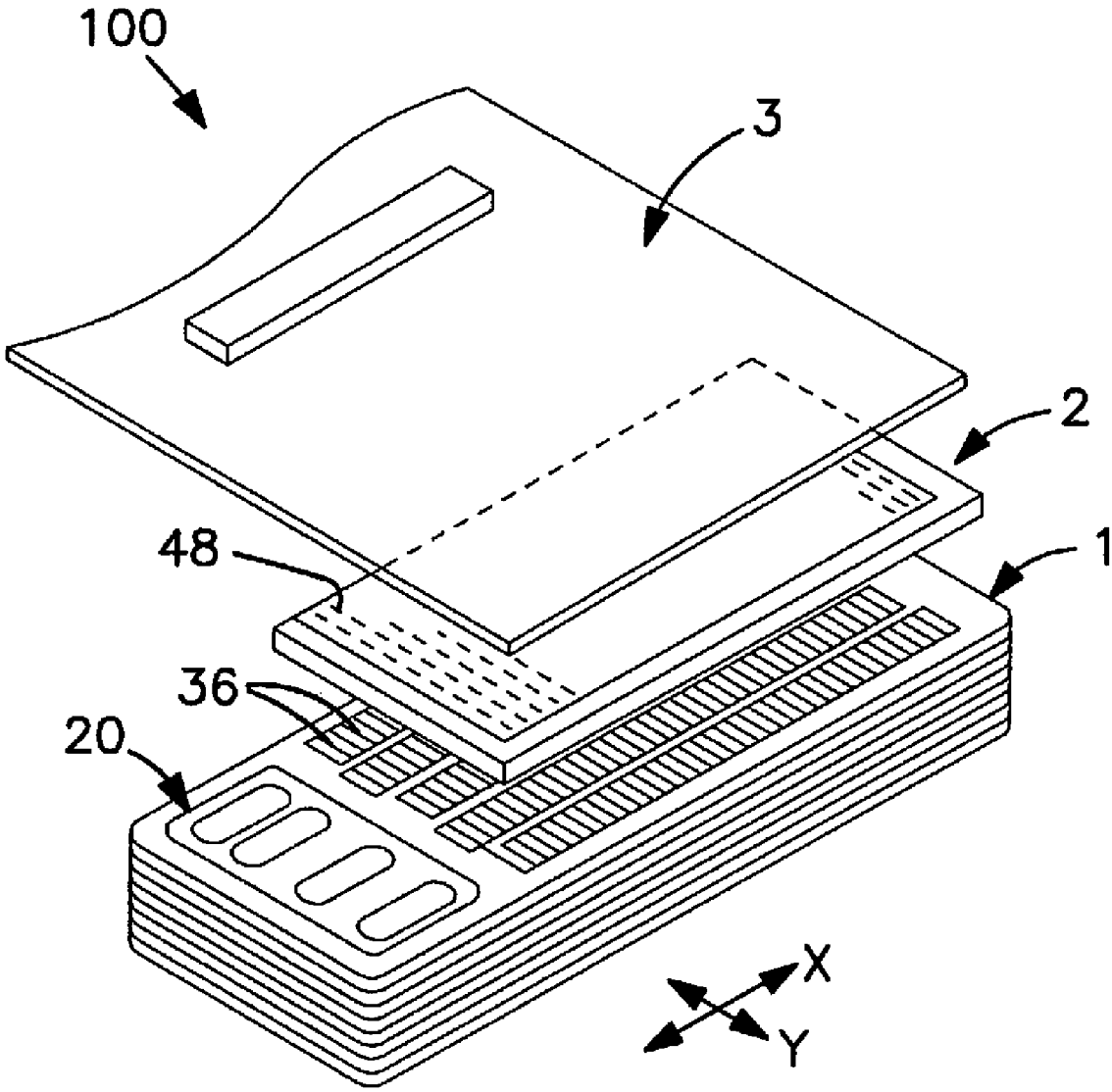
FIG. 1 is an oblique view of an ink-jet head which may be used in an ink-jet recording device according to an embodiment of the present invention.

An ink-jet head 100 as illustrated in FIG. 1 has a structure in which a plate type piezoelectric actuator 2 is joined to a cavity unit 1 composed of plural metal-made plates. A flexible flat cable 3 for connecting to an external instrument is superposed on and joined to the top (back face) of this plate type piezoelectric actuator 2. Then, an ink is ejected downwardly from a nozzle 4 pierced in a side of the bottom (front face) of the cavity unit 1.

Figure 2:
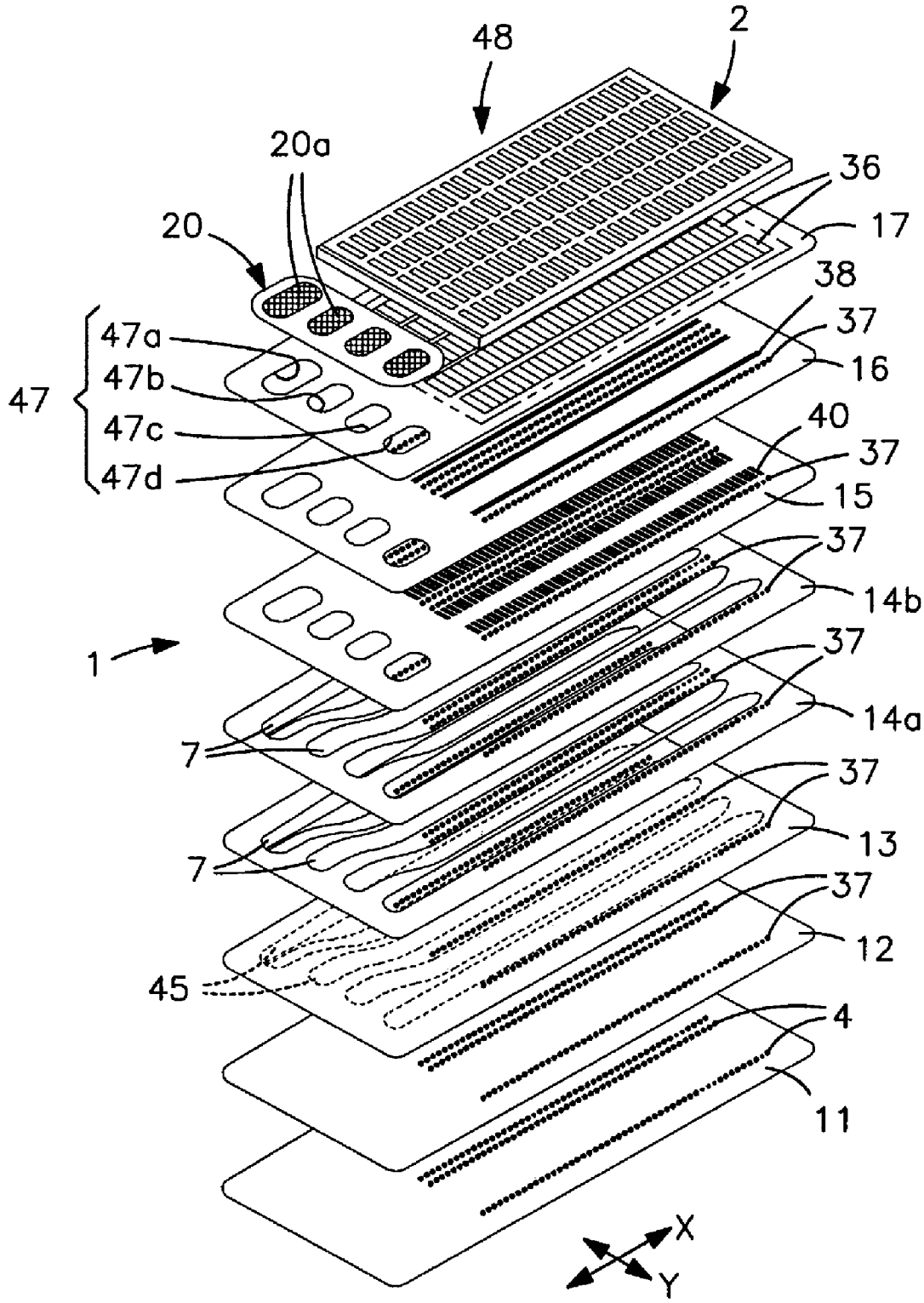
FIG. 2 is an exploded oblique view of an ink-jet head which is used in an ink-jet recording device according to an embodiment of the present invention.

As illustrated in FIG. 2, this cavity unit 1 has a structure in which eight thin plates of a nozzle plate 11, a spacer plate 12, a damper plate 13, two manifold plates 14*a* and 14*b*, a supply plate 15, a base plate 16 and a cavity plate 17 are superposed on and joined to each other, respectively for example by using an adhesive.

Each of the plates 11 to 17 usually has a thickness of from about 50 μm to about 150 μm, and the nozzle plate 11 may be made of a synthetic resin such as a polyimide and the like (e.g. a water or ink-repellant material to facilitate ejection of ink onto a recording material). Each of other plates 12 to 17 is usually made of a 42% nickel alloy steel plate. Other example materials include stainless steel (SUS), copper, aluminum, or other steel or nickel alloys. In the nozzle plate 11, a number of nozzles 4 for ink ejection each having a micro diameter are perforated at minute intervals. The nozzles 4 may be arranged in five lines substantially in parallel to the long side (X axis) in the nozzle plate 11.

Figure 3:
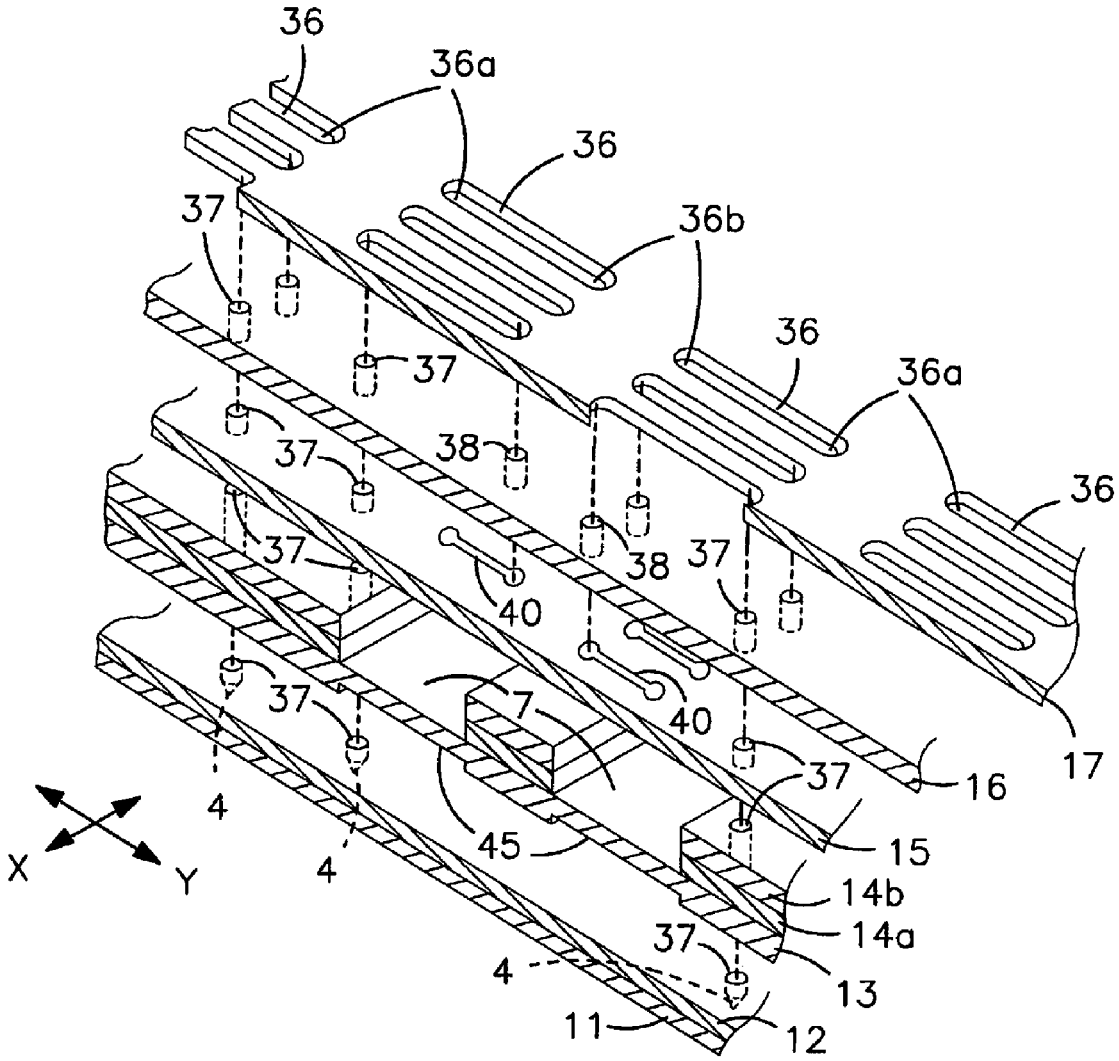
FIG. 3 is an enlarged exploded oblique view of a cavity unit which is applied to an ink-jet recording device according to an embodiment of the present invention.

As illustrated in FIG. 3, in the cavity plate 17, plural pressure chambers 36 are arranged in five lines in parallel to the long side (X direction) of the cavity plate 17. Each of the pressure chambers 36 may be formed in a slender shape in plan view and perforated such that longitudinal direction of the pressure chambers 36 follows the short side direction (Y direction) of the cavity plate 17; and the pressure chambers' one end part 36*a* in the longitudinal direction may be in communication with the nozzle 4, whereas the other end part 36*b* may be in communication with a common ink chamber 7 as described later.

The end part 36*a* of each of the pressure chambers 36 may be in communication with each of the nozzles 4 in the nozzle plate 11 via a communicating hole 37 having a micro size and perforated in the supply plate 15, the base plate 16, the two manifold plates 14*a* and 14*b*, the damper plate 13 and the spacer plate 12.

A through-hole 38 connected to the other end part 36*b* of each of the pressure chambers 36 may be perforated in the base plate 16 adjacent to the bottom of the cavity plate 17.

A connection passage 40 for supplying an ink into each of the pressure chambers 36 from the common ink chamber 7 as described later may be provided in the supply plate 15 adjacent to the bottom of the base plate 16.

Figure 4:
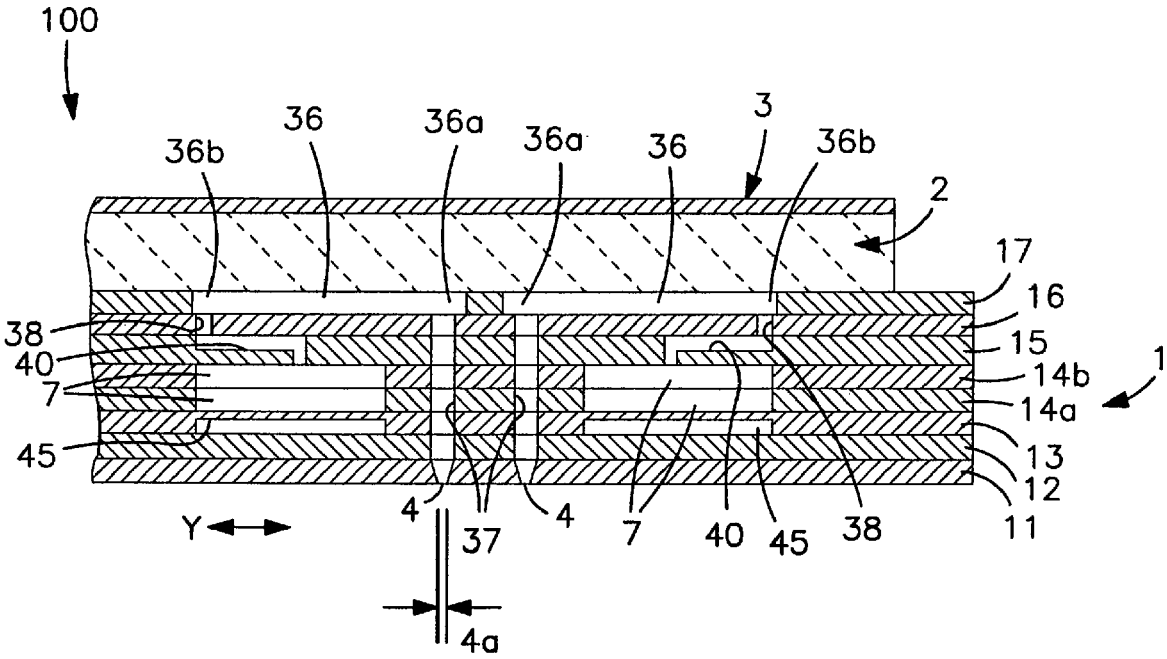
FIG. 4 is a enlarged cross-sectional view cut along the Y axis of FIG. 1.

Five long common ink chambers 7 may be formed in the two manifold plates 14*a* and 14*b* along the long side direction (X direction) thereof while penetrating through a plate thickness so as to extend along each line of the nozzle 4. That is, as illustrated in FIGS. 2 and 4, the two manifold plates 14*a* and 14*b* may be stacked, and the top of the stack may be covered by the supply plate 15, whereas the bottom thereof may be covered by the damper plate 13, whereby five common ink chambers (manifold chambers) 7 in total may be formed in a sealed state. In plan view from the stack direction of the respective plates, each of the common chambers 7 extends long along the line direction of the pressure chambers 36 (line direction of the nozzles 4) while partially superposing each of the pressure chambers 36.

As illustrated in FIGS. 3 and 4, a damper chamber 45 which may be remote from the common ink chamber 7 may be formed in a recess state in a side of the bottom of the damper plate 13 adjacent to the bottom of the manifold plate 14*a*. As illustrated in FIG. 2, the position and shape of each of the damper chambers 45 may be coincident with those of each of the common ink chambers 7. Because this damper plate 13 may be made of a metallic material capable of being properly elastically deformed, a thin plate-like ceiling part in an upper part of the damper chamber 45 may freely vibrate in not only the side of the common ink chamber 7 but also the side of the damper chamber 45. Even when a pressure fluctuation generated in the pressure chamber 36 is propagated into the common ink chamber 7 at the time of ink ejection, the ceiling part may be elastically deformed and vibrated, which exerts a damper effect to absorb the pressure. This is intended to reduce so-called crosstalk wherein the pressure fluctuation is propagated into other pressure chamber 36.

As illustrated in FIG. 2, in an end part of one of the short sides of each of the cavity plate 17, the base plate 16 and the supply plate 15, four ink supply openings 47 may be perforated in line with one another to allow the flow of ink therethrough. Ink supplied from an ink supply source may be communicated through these ink supply openings 47 to one end part of the common ink chamber 7. The four ink supply openings 47 are designated as 47*a*, 47*b*, 47*c* and 47*d* in order from the left hand side of FIG. 2.

An ink may be supplied to the common ink chamber 7 via an ink supply channel from the ink supply opening 47, and thereafter, as illustrated in FIG. 3, the ink may be distributed and supplied to each of the pressure chambers 36 through the connection passage 40 of the supply plate 15 and the through-hole 38 of the base plate 16. As described later, the ink goes through the communicating hole 37 from the inside of each of the pressure chambers 36 and reaches the nozzle 4 corresponding to that pressure chamber 36. When an ejection pressure is applied to the pressure chamber 36 upon driving of the piezoelectric actuator 2 as described later, a pressure wave goes through the communicating hole 37 from the inside of the pressure chamber 36 and reaches the nozzle 4, causing ink to be ejected.

In one embodiment, illustrated in FIG. 2 the ink-jet head may be provided with five common ink chambers 7, but only four ink supply openings 47. In one embodiment, ink supply opening 47*a* may then be connected to two common ink chambers 7. A black ink may be supplied to this ink supply opening 47*a* because black ink is used much more frequently than other colors. Yellow, magenta and cyan inks may be independently supplied to other supply openings 47*b*, 47*c* and 47*d*, respectively. A filter body 20 having a filtration part 20*a* corresponding to each aperture is joined to each of the ink supply openings 47*a*, 47*b*, 47*c* and 47*d* by an adhesive or the like.

Figure 5:
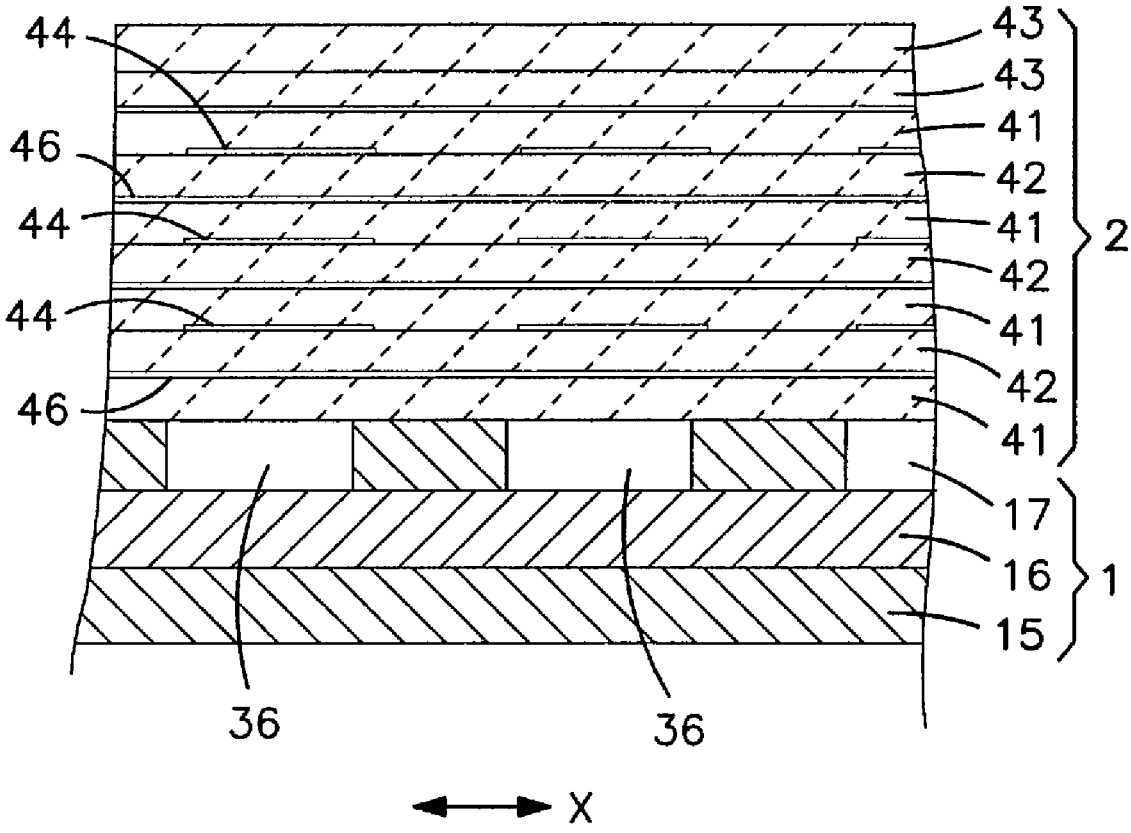
FIG. 5 is a cross-sectional view cut along the X axis of FIG. 1 of a piezoelectric actuator head which is used in an ink-jet recording device according to an embodiment of the present invention.

On the other hand, as illustrated in FIG. 5, the piezoelectric actuator 2 may have a structure in which plural piezoelectric sheets 41 to 43 each having a thickness of about 30 μm are stacked in a manner similar to a known structure as disclosed in, for example U.S. Pat. No. 5,402,159, incorporated by reference herein. Among the respective piezoelectric sheets, on the top (wide width face) of the piezoelectric sheet 42 at a prescribed even-numbered stage from the bottom, individual electrodes 44 having a narrow width may be formed in a line state in every place corresponding to each of the pressure chambers 36 in the cavity unit 1 in the direction of the X axis. A common electrode 46 which is common to the plural pressure chambers 36 may be formed on the top (wide width face) of the piezoelectric sheet 41 at a prescribed odd-numbered stage from the bottom. A surface electrode 48 electrically connected to each of the individual electrodes 44 corresponding to the stack direction and a surface electrode electrically connected to the common electrode 46 may be provided on the top of the uppermost sheet.

As is known in the art, when a high voltage is applied between the individual electrode 44 and the common electrode 46, a portion of the piezoelectric sheet positioned between both electrodes is polarized and becomes an active part.

An adhesive sheet (not illustrated) made of an ink-impermeable synthetic resin as an adhesive may be placed in advance over the entirety of the bottom (wide width face opposing to the pressure chamber 36) in this plate type piezoelectric actuator 2; and the piezoelectric actuator 2 may be then adhered and fixed to the cavity unit 1 by disposing each of the individual electrodes 44 opposing to each of the pressure chambers 36 in the cavity unit 1. By superposing and pressing the flexible flat cable 3, a wiring pattern of every kind (not illustrated) in this flexible flat cable 3 may be electrically jointed to each of the surface electrodes on the surface of the upper side in this piezoelectric actuator 2.

As described previously, the ink-jet head of the invention has an ink chamber (common ink chamber 7), a pressure chamber 36 in communication with the ink chamber via the connection passage 40, a nozzle 4 for ejecting an ink in communication with the pressure chamber 36 and the piezoelectric actuator 2 for applying an ejection pressure to an ink in the pressure chamber 36. The ink-jet head also has an ink passage extending from the boundary of the ink chamber to the tip of the nozzle 4.

In the thus configured ink-jet head of an embodiment of the invention, the tip of the nozzle 4 may be set up so as to have an aperture diameter (namely, a nozzle diameter 4*a*: a diameter of an aperture portion of the nozzle 4 pierced in the side of the bottom (front face) of the cavity unit 1 of FIG. 4) of from about 15 μm to about 25 μm. When the nozzle diameter is less than about 15 μm, the ejection rate of an ink droplet is too fast such that the ejection stability deteriorates, and an ink droplet near nozzle 4 is likely to dry up, causing ejection failure. In contrast, when the nozzle diameter is more than about 25 μm, the ejection rate of an ink droplet is too slow such that the ejection stability also deteriorates. In the ink-jet head of an embodiment of the invention, the nozzle 4 may be configured to have a nozzle for black ink and a nozzle for color ink. In this case, it is preferable that the nozzle diameter of the nozzle for black ink is equal to or larger than the nozzle diameter of the nozzle for color ink. It is preferable that a color ink droplet be small to allow printing with high resolution while obtaining photographic image quality; whereas because the black ink is principally used for text printing, it is preferable that the size of the black ink droplet be at least equal to or larger than the size of the color ink droplet. In a more specific embodiment, the nozzle diameter of the nozzle for black ink may be preferably from about 18 μm to about 25 μm, and more preferably from about 19 μm to about 21 μm; and the nozzle diameter of the nozzle for color ink may be preferably from about 15 μm to about 20 μm, and more preferably from about 16 μm to about 18 μm.

As described previously, in the ink-jet head of one embodiment of the invention, the ink passage may be configured such that when an ink having a viscosity of from about 2.5 mPa·s to about 3 mPa·s is passed through the ink passage, a passage resistance value is form about 50 kPa·s/mm$^3$ to about 100 kPa·s/mm$^3$.

An ink having a viscosity of from about 2.5 mPa·s to about 3 mPa·s is used so that the passage resistance value may be specified. In general, because a constricted region is formed in the connection passage as a part of the ink passage, when the ink viscosity is too high, a meniscus is hardly vibrated so that a small ink droplet is hardly ejected from the nozzle. Even when only a small amount of the moisture in the ink is evaporated, the viscosity of the ink may become too high, causing ejection failure. When the ink viscosity is too low, the vibration of a meniscus hardly ceases, also causing deterioration of ejection stability.

Other than the above viscosity restrictions, the ink described in the above embodiment may include any sort of ink. For example, it may include any liquid material having the prescribed viscosity that it is moved in the ink passage and ejected from the nozzle. Specifically, the presence or absence of a coloring material does not matter.

The viscosity may be a value measured by using a rotary viscometer (for example, a Brookfield's viscometer (Model: DV-II+)) under a measurement condition at a revolution speed of 60 rpm and a temperature of 25° C. Specifically, the viscosity may be a value determined from a resistance value from the boundary of the common ink chamber 7 to the tip 4 of the nozzle as illustrated in FIG. 4 according to a Hagen-Poiseuille equation. The passage resistance value may be defined as a value obtained by dividing an ink passage depending upon the shape and sectional area of the ink passage, determining the respective resistance values according to a Hagen-Poiseuille equation and summing up all the determined resistance values. The Hagen-Poiseuille equation is as follows.

$$\text{Passage resistance } [\text{Pa·s/mm}^3]=8\mu L/Sr^2$$

In the foregoing equation, μ represents a viscosity (Pa·s); L represents a passage length (mm); S represents a sectional area (mm$^2$); and r represents an equivalent radius (mm) {[equivalent radius (r)]=2×(passage sectional area)/(circumference of passage section)}.

In embodiments of the invention, the ink passage may be configured to have a passage resistance value as defined in this way of from about 50 kPa·s/mm$^3$ to about 100 kPa·s/mm$^3$, and preferably from about 50 kPa·s/mm$^3$ to about 85 kPa·s/mm$^3$. When the passage resistance is less than about 50 kPa·s/mm$^3$, the vibration of a meniscus hardly ceases, causing deterioration of ejection stability. When the passage resistance exceeds about 100 kPa·s/mm$^3$, the supply of ink may not keep up with its ejection, causing an omission of ejection or an ink droplet having a sufficiently large volume may not be ejected.

Figure 6:
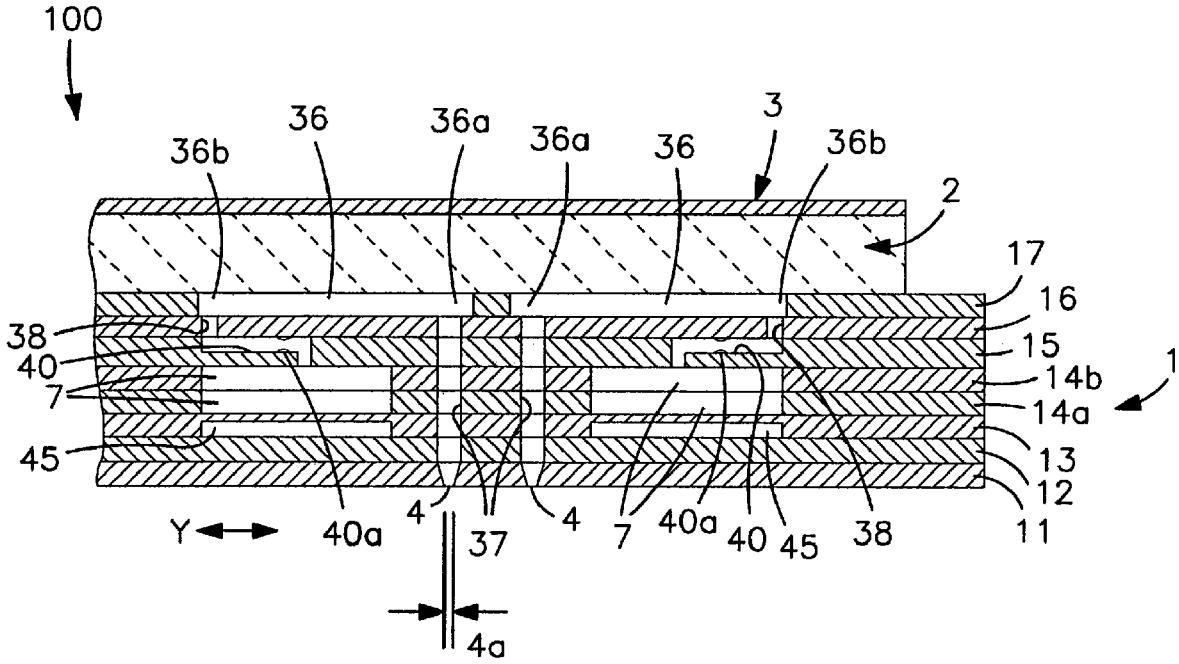
FIG. 6 is a modified example of the enlarged cross-sectional view cut along the Y axis of FIG. 1.

Examples of the configuration of the ink passage having such a passage resistance value include a configuration in which a sectional area of the connection passage is small, in other words, a configuration in which a constricted region is provided so as to make the sectional area of the connection passage small. In one ink-jet head configuration, the sectional area of the entirety of the connection passage may be made small by adjusting the width or thickness (in the thickness direction of the supply plate) of the connection passage. In this case, the entirety of the connection passage is a constricted region. Furthermore, as illustrated in FIG. 6, a region (namely, a constricted region) 40*a* in which a sectional area of the connection passage may be locally made small in an orthogonal direction to the ink flow direction may be provided in a part of the connection passage 40 between the ink chamber 7 and the pressure chamber 36. Such a constricted region may be provided to improve the efficiency of transferring pressure to the nozzle side and suppressing the transfer of a pressure to the common ink chamber 7. In another embodiment, the transfer of pressure to the common ink chamber 7 may be suppressed by providing fine irregularities on the internal face of the connection passage and making the volume of the pressure chamber small.

According to the ink-jet head of an embodiment of the invention, the aperture diameter of the tip of the nozzle may be very small, such as from about 15 μm to about 25 μm, the ink passage may be configured such that when an ink having a viscosity of from about 2.5 mPa·s to about 3 mPa·s is passed therethrough, a passage resistance value of the ink passage is from about 50 kPa·s/mm$^3$ to about 100 kPa·s/mm$^3$. Thus, it is possible to inject an ink droplet of several pl capable of forming an ink-jet image with high resolution on a recording medium with good ejection stability without causing substantial ejection failure.

In one embodiment ink-jet head may be associated with at least one ink cartridge, which may contain ink. The ink-jet head and the at least one ink cartridge may be separate or may be formed as an integral unit. The ink cartridge may be in communication with the nozzle 4 through the ink supply opening 47 and ink chamber 7 and the ink passage to allow the ink cartridge to supply ink to the nozzle.

Ink-jet heads as described above may be used in an ink-jet recording device. The ink-jet recording device of embodiments of the invention may further be provided with a black ink cartridge having a black ink therein and a color ink cartridge having a color ink therein. Conventionally known black ink cartridges and color ink cartridges may be used (see, for example U.S. Patent Application Publication Pub. No. US2005/0134663, incorporated by reference herein, and the like). In some embodiments case, it may be preferable that a pigment suitable for text printing is used as a coloring agent in the black ink and that a dye capable of forming a vivid color image is used as a coloring agent in the color ink. A pigment based black ink, as compared to a dye based color ink, has a tendency for its viscosity to become too high by evaporation of a small amount of the moisture, causing ejection failure. Accordingly, it may be preferable in such embodiments that the viscosity of the black ink is not more than the viscosity of the color ink. Concretely, the viscosity of the black ink may be from about 2.5 mPa·s to about 2.7 mPa·s, and the viscosity of the color ink may be from about 2.7 mPa·s to about 3 mPa·s. The viscosity may be adjusted by adjusting the kinds and amounts of a solvent, a dispersant, a viscosity modifier, and so on as described later.

An example ink for ink-jet recording to be applied in the ink-jet recording device of embodiments of the invention (for example, a black ink and a color ink) generally contains a coloring material, a solvent and the like. The coloring material may be any of a dye or a pigment. Though the dye is not particularly limited, examples thereof include water-soluble dyes such as direct dyes, acid dyes, basic dyes, reactive dyes and the like. Above all, specific examples of dyes which meet performances such as vividness, solubility in water, stability and light fastness include C.I. Direct Black 17, 19, 32, 51, 71, 108, 146, 154 and 168; C.I. Direct Blue 6, 22, 25, 71, 86, 90, 106 and 199; C.I. Direct Red 1, 4, 17, 28, 83 and 227; C.I. Direct Yellow 12, 24, 26, 86, 98, 132 and 142; C.I. Direct Orange 34, 39, 44, 46 and 60; C.I. Direct Violet 47 and 48; C.I. Direct Brown 109; C.I. Direct Green 59; C.I. Acid Black 2, 7, 24, 26, 31, 52, 63, 112 and 118, C.I. Acid Blue 9, 22, 40, 59, 93, 102, 104, 117, 120, 229 and 234; C.I. Acid Red 1, 6, 32, 37, 51, 52, 80, 85, 87, 92, 94, 115, 180, 256, 289, 315 and 317; C.I. Acid Yellow 11, 17, 23, 25, 29, 42, 61 and 71; C.I. Acid Orange 7 and 19; C.I. Acid Violet 49; C.I. Basic Black 2; C.I. Basic Blue 1, 3, 5, 7, 9, 24, 25, 26, 28 and 29; C.I. Basic Red 1, 2, 9, 12, 13, 14 and 37; C.I. Basic Violet 7, 14 and 27; C.I. Food Black 1 and 2; and the like.

In order that the foregoing dye may exhibit stability and may not generate a precipitate, its amount in the ink for ink-jet recording is in general from about 0.1 wt % to about 20 wt % based on the whole amount of the ink.

The pigment is not particularly limited but may be any of an inorganic pigment or an organic pigment. Of the foregoing pigments, examples of pigments which are suitable for black-and-white recording include carbon blacks such as furnace black, lamp black, acetylene black, channel black and the like; metal oxides such as titanium oxide and the like; and organic pigments such as orthonitroaniline black and the like. Of the foregoing pigments, examples of pigments which are suitable for color recording include Toluidine Red, Permanent Carmine FB, Fast Yellow AAA, Disazo Orange PMP, Lake Red C, Brilliant Carmine 6B, Phthalocyanine Blue, Quinacridone Red, Dioxane Violet, Victoria Pure Blue, Alkali Blue Toner, Fast Yellow 10G, Disazo Yellow AAOT, Disazo Yellow AAMX, Disazo Yellow HR, Disazo Yellow AAOA, yellow iron oxide, orthonitroaniline orange, dinitroaniline orange, Vulcan Orange, Toluidine Red, Chlorinated Para Red, Brilliant Fast Scarlet, Naphthol Red 23, Pyrazolone Red, Barium Red 2B, Calcium Red 2B, Strontium Red 2B, Mangan Red 2B, Barium Lissome Red, Pigment Scarlet 3B Lake, Lake Bordeaux 10B, Anthosin 3B Lake, Anthosin 5B Lake, Rhodamine 6G Lake, Eosin Lake, red iron oxide, Naphthol Red FGR, Rhodamine B Lake, Methyl Violet Lake, Dioxazine Violet, Basic Blue 5B Lake, Basic Blue 6G Lake, Fast Sky Blue, Alkali Blue R Toner, Peacock Blue Lake, prussian blue, ultramarine blue, Reflex Blue 2G, Reflex Blue R, Brilliant Green Lake, Diamond Green Thioflavine Lake, Phthalocyanine Green G, Green Gold, Phthalocyanine Green Y, iron oxide, rust powder, zinc oxide, titanium oxide, calcium carbonate, clay, barium sulfate, alumina white, aluminum, bronze, daylight fluorescent pigment, pearl pigment, Naphthol Carmine FB, Naphthol Red M, Permanent Carmine FB, Fast Yellow G, Disazo Yellow AAA, Alkali Blue G Toner, and surface-modified pigments obtained by treating the surface of the pigment with a specified functional group.

The amount of the pigment in the ink for ink-jet recording may vary depending on a desired printing density and color. However, for the purpose of obtaining sufficient coloring force and high vividness, the amount may generally be from about 1 wt % to about 20 wt %, and may preferably be from about 1 wt % to about 15 wt % based on the whole amount of the ink for ink-jet recording.

When the ink for ink-jet recording contains pigment, a dispersant may be added therein as the need arises. Though the dispersant is not specifically limited, examples thereof include high molecular weight polyurethane; polyesters; and high molecular weight copolymers containing a functional group having strong affinity with the pigment, for example, a carbonyl group and an amino group.

It may be preferable that the ink contains, as the solvent, a mixed solvent of water and a water-soluble organic solvent.

It may be preferable that deionized water be used as the water. Though the amount of the water in the ink for ink-jet recording may vary over a wide range depending on the type and composition of the water-soluble organic solvent and desired characteristics of the ink, it may be generally from about 10 wt % to about 95 wt %, it may preferably be from about 10 wt % to about 70 wt %, and it may more preferably from about 20 wt % to about 70 wt % based on the whole amount of the ink.

The water-soluble organic solvent may be principally classified into a humectant having an effect for preventing the ink from drying in the nozzle tip part of the ink-jet head and a penetrant capable of fastening the drying velocity on a medium to be recorded. Though the water-soluble organic solvent as the humectant is not specifically limited, examples thereof include lower alcohols such as methyl alcohol, ethyl alcohol, n-propyl alcohol, isopropyl alcohol, n-butyl alcohol, sec-butyl alcohol, tert-butyl alcohol and the like; amides such as dimethylformamide, dimethylacetamide and the like; ketones or keto alcohols such as acetone, diacetone alcohol and the like; ethers such as tetrahydrofuran, dioxane and the like; polyalkylene glycols such as polyethylene glycol, polypropylene glycol and the like; alkylene glycols such as ethylene glycol, propylene glycol, butylene glycol, diethylene glycol, triethylene glycol, dipropylene glycol, tripropylene glycol, thiodiglycol, hexylene glycol and the like; glycerin; 2-pyrrolidone; N-methyl-2-pyrrolidone; 1,3-dimethyl-2-imidazolidinone; and the like. Of these, alkylene glycols and polyhydric alcohols such as glycerin are preferable.

The amount of the water-soluble organic solvent as the humectant in the ink for ink-jet recording may be generally from 0 wt % to 95 wt %, it may preferably be from about 10 wt % to about 80 wt %, and it may more preferably be from about 10 wt % to about 50 wt % based on the whole amount of the ink.

Though the water-soluble organic solvent as the penetrant is not particularly limited, examples thereof include glycol based ethers such as ethylene glycol methyl ether, ethylene glycol ethyl ether, ethylene glycol propyl ether, diethylene glycol methyl ether, diethylene glycol ethyl ether, diethylene glycol propyl ether, triethylene glycol methyl ether, triethylene glycol ethyl ether, triethylene glycol propyl ether, propylene glycol methyl ether, propylene glycol ethyl ether, propylene glycol propyl ether, dipropylene glycol methyl ether, dipropylene glycol ethyl ether, dipropylene glycol propyl ether, tripropylene glycol methyl ether, tripropylene glycol ethyl ether, tripropylene glycol propyl ether and the like.

With respect to the amount of the water-soluble organic solvent as the penetrant, when the amount is excessively large, the permeability of the ink into a recording medium becomes excessively high, thereby possibly causing bleeding. Accordingly, the amount may be generally from 0 wt % to about 20 wt %, it may preferably be from about 0.1 wt % to about 15 wt %, and it may more preferably be from about 1 wt % to about 10 wt % based on the whole amount of the ink.

If desired, the ink may further contain conventionally known additives such as a viscosity adjuster, for example polyvinyl alcohol, cellulose and water-soluble resins, a surface tension modifier and a mildewproofing agent.

In one embodiment the ink-jet recording device may include an ink-jet head and at least one ink cartridge, which may contain ink. The ink-jet head and the at least one ink cartridge may be separate or may be formed as an integral unit.

In a specific embodiment, the ink-jet recording device may have a configuration of a conventionally known ink-jet recording device, such as the device in U.S. Patent Application Publication Pub. No. US2005/0062805 A1, incorporated by reference herein.

EXAMPLES

The following examples are provided only to illustrate certain embodiments of the description and are not intended to embody the total scope of the invention or any embodiment thereof. Variations of the exemplary embodiments below are intended to be included within the scope of the invention.

Initially, black inks (Inks 1 to 6) and color inks (Ink 7 to 12) each having a composition as summarized in Table 1 were prepared by the usual way. The viscosity of each of these inks was measured by using a rotary viscometer (Brookfield's viscometer (Model: DV-II+)) under a measurement condition at a revolution speed of 60 rpm and a temperature of 25° C. A viscosity standard liquid was measured at n=5 every time, and a measured value of viscosity of the actual ink was corrected from its average value and its detected value. For example, when a detected value (a) of the viscosity standard liquid is 4.80 mPa·s, an average value (b) of measured values of the viscosity standard liquid at n=5 is 4.85 mPa·s, whereas when an average value (c) of measured values of an ink whose viscosity is intended to be determined at n=5 is 3.00 mPa·s, a viscosity of the ink to be determined is calculated according to an equation of [(c)×(a)/(b)] and found to be 2.97 mPa·s.

TABLE 1

| | | Ink | | | | | | | | | | | |
|---|---|---|---|---|---|---|---|---|---|---|---|---|---|
| | | 1 | 2 | 3 | 4 | 5 | 6 | 7 | 8 | 9 | 10 | 11 | 12 |
| Ink composition (wt %) | CAB-O-JET 300 ®*1 | 30.0 | 30.0 | 30.0 | 30.0 | 30.0 | 30.0 | — | — | — | — | — | — |
| | C.I. Acid Red 52 | — | — | — | — | — | — | 1.5 | — | 1.5 | — | 1.5 | — |
| | C.I. Acid Red 289 | — | — | — | — | — | — | 1.5 | — | 1.5 | — | 1.5 | — |
| | C.I. Direct Blue 199 | — | — | — | — | — | — | — | 3.0 | — | 3.0 | — | 3.0 |
| | Triethylene glycol butyl ether | 4.5 | 4.5 | 4.5 | 4.5 | 4.5 | 4.5 | 4.5 | 4.5 | 4.5 | 4.5 | 4.5 | 4.5 |
| | OLFINE ® E1010*2 | 0.2 | 0.2 | 0.2 | 0.2 | 0.2 | 0.2 | 0.2 | 0.2 | 0.2 | 0.2 | 0.2 | 0.2 |
| | Proxel XL-2 (S)*3 | 0.2 | 0.2 | 0.2 | 0.2 | 0.2 | 0.2 | 0.2 | 0.2 | 0.2 | 0.2 | 0.2 | 0.2 |
| | Glycerin | 15.0 | 16.3 | 17.7 | 18.9 | 22.8 | 24.0 | 21.1 | 22.0 | 23.8 | 24.7 | 26.5 | 27.4 |
| | Water | Balance | Balance | Balance | Balance | Balance | Balance | Balance | Balance | Balance | Balance | Balance | Balance |
| Viscosity [mPa · s] | | 2.4 | 2.5 | 2.6 | 2.7 | 3.0 | 3.1 | 2.4 | 2.5 | 2.7 | 2.8 | 3.0 | 3.1 |

*1Produced by Cabot Corporation, solids concentration of coloring agent = 15 wt %
*2Acetylene glycol based surfactant, produced by Nissin Chemical Industry Co., Ltd.
*3Mildewproofing agent, produced by Arch Chemicals, Inc.

Example 1

Using each of Inks 1 to 6 (black inks) as summarized in Table 1, an ink-jet head having a nozzle diameter and a passage resistance value as summarized in Table 2, as illustrated in FIGS. 1 to 5, was installed in a digital multifunction device equipped with an ink-jet printer DCP-110C (product from Brother Industries, Ltd.) and subjected to continuous printing evaluation of 100 million dots (about 30,000 sheets), followed by evaluation according to the following criteria. The obtained results are shown in Table 2.

Criteria of Ejection Test Evaluation

Excellent: Non-ejection and bending of ejection are not observed at all during the continuous printing.

Good: Non-ejection or bending of ejection is slightly observed during the continuous printing. However, the non-ejection or bending of ejection is remedied by purging the nozzle within 5 tries.

Poor: Non-ejection and bending of ejection are remarkably observed during the continuous printing. Both the non-ejection and the bending of ejection are not remedied by purging the nozzle within 5 tries.

Example 2

Using each of Inks 7 to 12 (color inks) as summarized in Table 1, an ink-jet head having a nozzle diameter and a passage resistance value as summarized in Table 3, as illustrated in FIGS. 1 to 5, was installed in a digital multifunction device equipped with an ink-jet printer DCP-110C (product from Brother Industries, Ltd.) and subjected to continuous printing evaluation of 100 million dots (about 30,000 sheets)

in the same manner as in Example 1, followed by evaluation in the same manner as in Example 1. The obtained results are shown in Table 3.

TABLE 2

| Nozzle diameter [μm] | Passage resistance [kPa · s/mm$^3$] | Ink (viscosity [mPa · s]) Ink 1 (2.4) | Ink 2 (2.5) | Ink 3 (2.6) | Ink 4 (2.7) | Ink 5 (3.0) | Ink 6 (3.1) |
|---|---|---|---|---|---|---|---|
| 18 | 62 | — | — | Good | — | — | — |
| 20 | 39 | — | — | Poor*$^A$ | — | — | — |
| | 44 | — | — | Poor*$^A$ | — | — | — |
| | 57 | Poor*$^B$ | — | — | — | — | — |
| | 60 | — | Excellent | — | — | — | — |
| | 62 | — | — | Excellent | — | — | — |
| | 64 | — | — | — | Excellent | — | — |
| | 72 | — | — | — | — | Good | — |
| | 74 | — | — | — | — | — | Poor*$^B$ |
| | 92 | — | — | Good | — | — | — |
| | 113 | — | — | Poor*$^A$ | — | — | — |
| 25 | 62 | — | — | Good | — | — | — |
| 30 | | — | — | Poor*$^C$ | — | — | — |

*$^A$The ejection test is poor, because the passage resistance falls outside the range.
*$^B$The ejection test is poor, because the viscosity falls outside the range.
*$^C$The ejection test is poor, because the nozzle diameter falls outside the range.

TABLE 3

| Nozzle diameter [μm] | Passage resistance [kPa · s/mm$^3$] | Ink (viscosity [mPa · s]) Ink 7 (2.4) | Ink 8 (2.5) | Ink 9 (2.7) | Ink 10 (2.8) | Ink 11 (3.0) | Ink 12 (3.1) |
|---|---|---|---|---|---|---|---|
| 13 | 67 | — | — | — | Poor*$^C$ | — | — |
| 15 | | — | — | — | Good | — | — |
| 17 | 42 | — | — | — | Poor*$^A$ | — | — |
| | 47 | — | — | — | Poor*$^A$ | — | — |
| | 52 | — | — | — | Excellent | — | — |
| | 57 | Poor*$^B$ | — | — | — | — | — |
| | 60 | — | Good | — | — | — | — |
| | 65 | — | — | Excellent | — | — | — |
| | 67 | — | — | — | Excellent | — | — |
| | 72 | — | — | — | — | Excellent | — |
| | 74 | — | — | — | — | — | Poor*$^B$ |
| | 97 | — | — | — | Good | — | — |
| | 119 | — | — | — | Poor*$^A$ | — | — |
| 20 | 67 | — | — | — | Good | — | — |

*$^A$The ejection test is poor, because the passage resistance falls outside the range.
*$^B$The ejection test is poor, because the viscosity falls outside the range.
*$^C$The ejection test is poor, because the nozzle diameter falls outside the range.

Evaluation

In Examples 1 and 2, as expressed by "*A", when the passage resistance fell outside the range of from 50 kPa·s/mm$^3$ to 100 kPa·s/mm$^3$, the evaluation of the ejection test became poor. Furthermore, as expressed by "*C", when the nozzle diameter fell outside the range of from 15 μm to 25 μm, the evaluation of the ejection test became poor. As expressed by "*B", when the viscosity of the used ink fell outside the range of from 2.5 mPa·s to 3.0 mPa·s, it was noted that the evaluation of the ejection test became poor. Accordingly, when the nozzle diameter is from 15 μm to 25 μm and an ink having a viscosity of from 2.5 mPa·s to 3.0 mPa·s is passed through the ink passage, by combining an ink-jet head configured to have a passage resistance of the ink passage of the ink head of from 50 kPa·s/mm$^3$ to 100 kPa·s/mm$^3$ with an ink for ink-jet recording having a viscosity of from 2.5 mPa·s to 3.0 mPa·s, it becomes possible to stably eject a small droplet of several pl.

Although embodiments of the present invention have been described in detail herein, the scope of the invention is not limited thereto. It will be appreciated by those of ordinary skill in the relevant art that various modifications may be made without departing from the scope of the invention. Accordingly, the embodiments disclosed herein are exemplary. It is to be understood that the scope of the invention is not to be limited thereby, but is to be determined by the claims which follow.

What is claimed is:

1. An ink-jet head comprising:

an ink chamber;

a pressure chamber in communication with the ink chamber;

a nozzle for ejecting an ink in communication with the pressure chamber;

a piezoelectric actuator for applying an ejection pressure to an ink in the pressure chamber; and an ink passage extending from a boundary of the ink chamber to a tip of the nozzle, wherein the tip of the nozzle has an aperture diameter of from about 15 to about 25 μm, and the ink passage is configured such that when an ink having a viscosity of from about 2.5 to about 3 mPa·s is passed therethrough, a passage resistance value of the ink passage is from about 50 to about 100 kPa·s/mm$^3$.

2. The ink-jet head according to claim 1, wherein the ink passage comprises a connection passage extending from the boundary of the ink chamber to a boundary of the pressure chamber, and wherein a constricted region is provided in the connection passage such that when an ink having a viscosity of from about 2.5 to about 3 mPa·s is passed through the connection passage, a passage resistance value of the ink passage is from about 50 to about 100 kPa·s/mm$^3$.

3. The ink-jet head according to claim 1 comprising a nozzle for black ink and a nozzle for color ink, wherein an aperture diameter of a tip of the nozzle for black ink is equal to or larger than an aperture diameter of a tip of the nozzle for color ink.

4. The ink-jet head according to claim 3, wherein the aperture diameter of the tip of the nozzle for black ink is from about 18 to about 25 μm, and the aperture diameter of the tip of the nozzle for color ink is from about 15 to about 20 μm.

5. The ink-jet head according to claim 1, wherein the passage resistance value of the ink passage is calculated using the Hagen-Poiseuille equation.

6. The ink-jet head according to claim 1, further comprising an ink supply opening in communication with the ink chamber.

7. The ink-jet head according to claim 6, comprising a plurality of ink supply openings and a plurality of ink chambers, wherein one ink supply opening is in communication with at least two ink chambers.

8. An ink-jet recording device comprising an ink-jet head comprising:

an ink chamber;

a pressure chamber in communication with the ink chamber;

a nozzle for ejecting an ink in communication with the pressure chamber;

a piezoelectric actuator for applying an ejection pressure to an ink in the pressure chamber; and an ink passage extending from a boundary of the ink chamber to a tip of the nozzle, wherein the tip of the nozzle has an aperture diameter of from about 15 to about 25 μm, and the ink passage is configured such that when an ink having a viscosity of from about 2.5 to about 3 mPa·s is passed therethrough, a passage resistance value of the ink passage is from about 50 to about 100 kPa·s/mm$^3$.

9. The ink-jet recording device according to claim 8, wherein the ink passage comprises a connection passage extending from the boundary of the ink chamber to a boundary of the pressure chamber, and wherein a constricted region is provided in the connection passage such that when an ink having a viscosity of from about 2.5 to about 3 mPa·s is passed through the connection passage, a passage resistance value of the ink passage is from about 50 to about 100 kPa·s/mm$^3$.

10. The ink-jet recording device according to claim 8 comprising a nozzle for black ink and a nozzle for color ink, wherein an aperture diameter of a tip of the nozzle for black ink is equal to or larger than an aperture diameter of a tip of the nozzle for color ink.

11. The ink-jet recording device according to claim 10, wherein the aperture diameter of the tip of the nozzle for black ink is from about 18 to about 25 μm, and the aperture diameter of the tip of the nozzle for color ink is from about 15 to about 20 μm.

12. The ink-jet recording device according to claim 8, further comprising a black ink cartridge containing a black ink and a color ink cartridge containing a color ink, wherein a viscosity of the black ink is not more than a viscosity of the color ink.

13. The ink-jet recording device according to claim 12, wherein the viscosity of the black ink is from about 2.5 to about 2.7 mPa·s, and the viscosity of the color ink is from about 2.7 to about 3 mPa·s.

14. The ink-jet recording device according to claim 12, wherein a coloring agent of the black ink is a pigment, and a coloring agent of the color ink is a dye.

15. The ink-jet recording device according to claim 8, wherein the passage resistance value of the ink passage is calculated using the Hagen-Poiseuille equation.

16. The ink-jet recording device according to claim 8, further comprising an ink supply opening in communication with the ink chamber.

17. The ink-jet recording device according to claim 16, comprising a plurality of ink supply openings and a plurality of ink chambers, wherein one ink supply opening is in communication with at least two ink chambers.

18. The ink-jet recording device according to claim 17, wherein the one ink supply opening in communication with at least two ink chambers is further in communication with a black ink cartridge.

19. An ink-jet recording device comprising:

an ink jet head comprising:

an ink chamber;

a pressure chamber in communication with the ink chamber;

a nozzle for ejecting an ink in communication with the pressure chamber;

a piezoelectric actuator for applying an ejection pressure to an ink in the pressure chamber; and an ink passage extending from a boundary of the ink chamber to a tip of the nozzle; and a cartridge containing ink in communication with the ink chamber, wherein the tip of the nozzle has an aperture diameter of from about 15 to about 25 μm, and the ink passage is configured such that when an ink having a viscosity of from about 2.5 to about 3 mPa·s is passed therethrough, a passage resistance value of the ink passage is from about 50 to about 100 kPa·s/mm$^3$.

20. The ink-jet recording device of claim 19, wherein the ink-jet head and cartridge are formed as an integral unit.

* * * * *